United States Patent [19]

Suzuki et al.

[11] Patent Number: 4,994,820

[45] Date of Patent: Feb. 19, 1991

[54] PLANE ANTENNA

[75] Inventors: Hidetaka Suzuki, Yokohama; Harumi Okazaki, Fujisawa; Motoki Hirano, Yokohama, all of Japan

[73] Assignee: Nissan Motor Co., Ltd., Tokyo, Japan

[21] Appl. No.: 446,841

[22] Filed: Dec. 6, 1989

[30] Foreign Application Priority Data

Dec. 16, 1988 [JP] Japan ..... 63-316219

[51] Int. Cl.[5] ..... H01Q 1/48

[52] U.S. Cl. ..... 343/846; 343/700 MS; 343/847

[58] Field of Search ..... 343/846, 847, 848, 829, 343/700 MS

[56] References Cited

U.S. PATENT DOCUMENTS

| | | | |
|---|---|---|---|
| 2,996,713 | 8/1961 | Boyer | 343/850 |
| 3,656,160 | 4/1972 | Burton | 343/846 |
| 4,761,654 | 8/1988 | Zaghloul | 343/846 |

FOREIGN PATENT DOCUMENTS

| | | |
|---|---|---|
| 63-125004 | 5/1988 | Japan . |
| 63-258102 | 10/1988 | Japan . |

*Primary Examiner*—Rolf Hille
*Assistant Examiner*—Hoanganh Le
*Attorney, Agent, or Firm*—Pennie & Edmonds

[57] ABSTRACT

A plane antenna comprising first and second plates made of a synthetic resin. The first plate has a first metal film formed thereon and the second plate has a second metal film formed thereon. A plurality of pins extend between the first and second plates for maintaining the first and second plates in spaced-parallel relation to each other with the first and second films facing to each other. The pins include at least one first pin for providing an electric connection between the first and second metal films and a second pin insulated from the second metal film for providing an electric connection of the first metal film to a lead wire. The first and second metal films have a spacific resistance $\rho$ [m] and a permeability $\mu$ [H/m]. The first and second metal films have a thickness greater than a value t [m] calculated from an equation as follows:

$$t = \sqrt{\rho/\pi \cdot f \cdot \mu}$$

where f is a signal frequency [Hz] for which the plane antenna is used.

6 Claims, 5 Drawing Sheets

PLANE ANTENNA

BACKGROUND OF THE INVENTION

This invention relates to a plane antenna having two conductive plates maintained in spaced-parallel relation to each other.

For example, Japanese Patent Kokai Nos. 59-200503 and 59-207705 disclose plane antennas having two metal disc plates maintained in spaced-parallel relation to each other by means of a plurality of metal pins. However, such conventional plane antennas employ a number of separate parts and thus require an increased number of separate assembling processes. Therefore, it is difficult to produce plane antenna on a mass production basis. In addition, since such conventional plane antennas are heavy and subject to a great moment, they are unsuitable for attachment on an automotive vehicle.

SUMMARY OF THE INVENTION

Therefore, it is a main object of the invention to provide a light plane antenna which can be produced on a mass production basis with ease.

There is provided, in accordance with the invention, a plane antenna comprising a first plate made of a synthetic resin, the first plate having a first metal film formed thereon, and a second plate made of a synthetic resin, the second plate having a second metal film formed thereon. The plane antenna also includes a plurality of pins extending between the first and second plates for maintaining the first and second plates in spaced-parallel relation to each other with the first and second films facing to each other. The pins include at least one first pin for providing an electric connection between the first and second metal films and a second pin insulated from the second metal film for providing an electric connection of the first metal film to a lead wire. The first and second metal films have a spacific resistance $\rho$ [$\Omega$·m] and a permeability $\mu$ [H/m]. The first and second metal films have a thickness greater than a value t [m] calculated from an equation as follows:

$$t = \sqrt{\rho/\pi \cdot f \cdot \mu}$$

where f is a signal frequency [Hz] for which the plane antenna is used.

BRIEF DESCRIPTION OF THE DRAWINGS

This invention will be described in greater detail by reference to the following description taken in connection with the accompanying drawings in which.

DETAILED DESCRIPTION OF THE INVENTION

Figure 1:
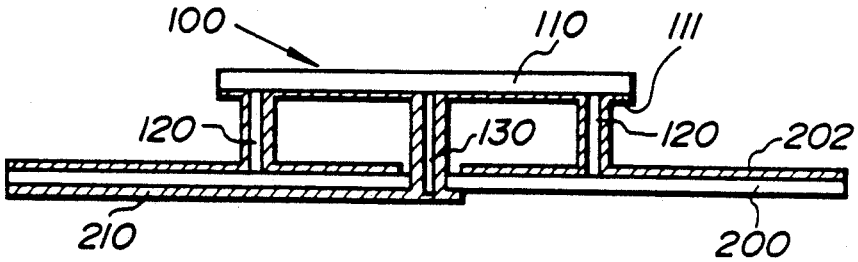
FIG. 1 is a sectional view showing one embodiment of a plane antenna made in accordance with the invention.
Figure 2A:
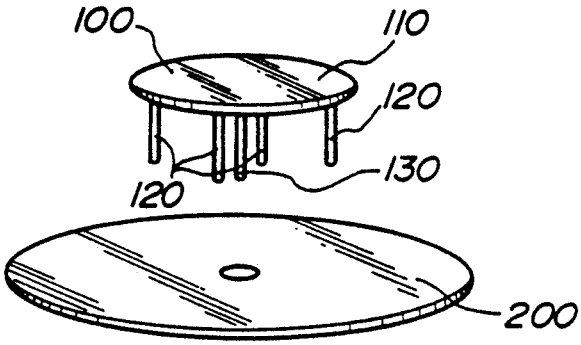
FIG. 2A is an exploded perspective view of the plane antenna.
Figure 2B:
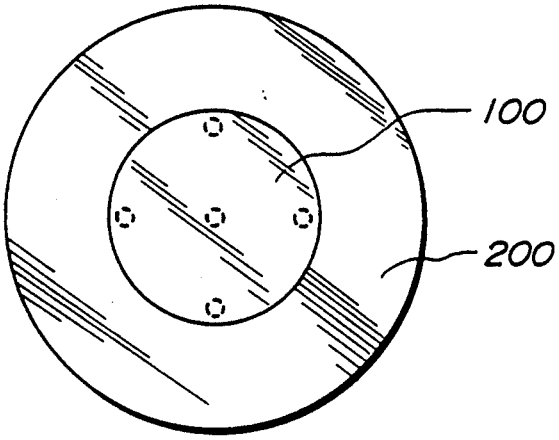
FIG. 2B is a plan view of the plane antenna.
Figure 2C:
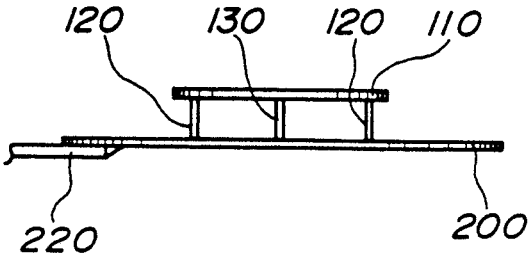
FIG. 2C is a side view of the plane antenna.

With reference to the drawings, wherein like numerals refer to like parts in the several views, and in particular to FIG. 1, there is shown one embodiment of a plate antenna made in accordance with the invention. The plate antenna comprises first and second members 100 and 200 made of a synthetic resin. The first member 100, which is molded integrally by an injection molding technique, includes a disc-shaped patch portion 110 and pins projecting from the patch portion 110, as best shown in FIG. 2A. These pins include a plurality of (in the illustrated case four) short pins 120 spaced circumferentially of the disc portion 110 and a feeder pin 130 arranged at the center of the disc portion 110, as best shown in FIG. 2B. The feeder pin 130 has a length somewhat longer than the length of the short pins 120. The second member 200 is molded separately from the first member 100 by an injection molding technique. The second member 200 has a disc shape and it is formed with a through-hole 204 at the center thereof. The short pins 120 are bonded to the second member 200 with the feeder pin 130 extending into the center hole 204 of the second member 200 so that the patch portion 110 is positioned in spaced parallel relation to the second member 200, as shown in FIG. 2C.

Figure 3A:
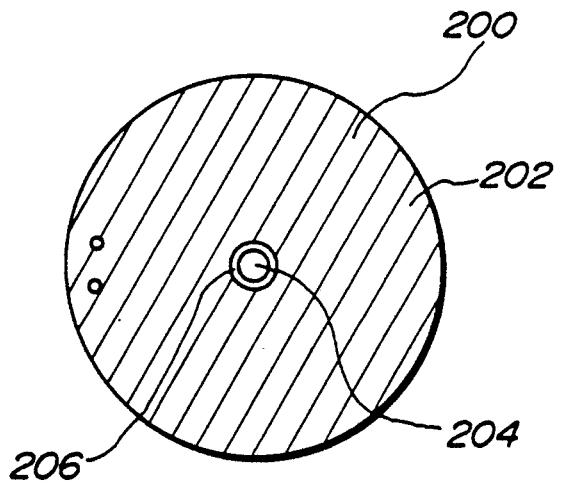
FIG. 3A is a plan view of the second member used in the plane antenna.
Figure 3B:
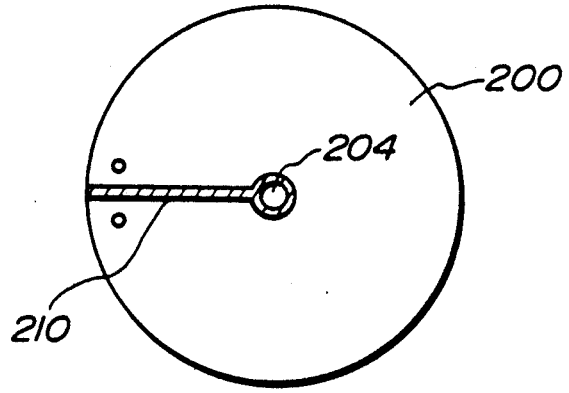
FIG. 3B is a bottom view of the second member.
Figure 3C:
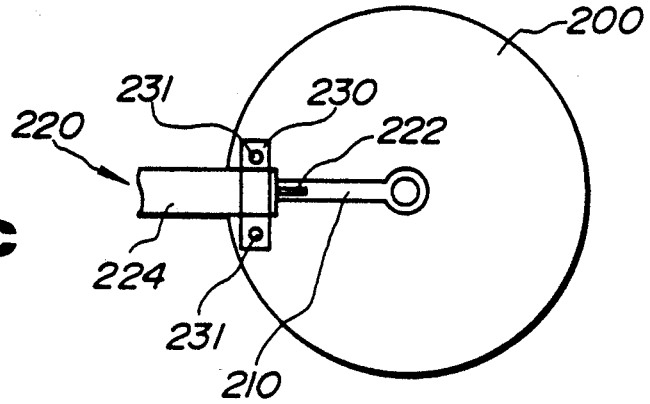
FIG. 3C is a bottom view showing a coaxial cable attached to the second member.

A metal film 202 is disposed on the entire area of one of the opposite surfaces of the second member 200 except for an annular insulating portion 206 surrounding the center hole 204, as shown in FIG. 3A. This metal film 202 serves as the earth plate of the plate antenna. A metal film is also disposed on the other surface of the second member 200 to form a micro strip line 210 extending radially from the center of the second member 200, as shown in FIG. 3B. The numeral 220 designates a coaxial cable having center threads 222 soldered on the micro strip line 210. The center threads 222 is connected to the input or output terminal of a transmitter/-receover unit. The threads 222 is covered by a sheath 224 of braided sheath 224 connected to the earth terminal of the transmitter/receiver unit. A metal band 230 is bolted by screws 231 to fix the shread 224 on the other surface of the second member 200, as shown in FIG. 3C. The first member 100 has a metal film 111 disposed around the pins 120 and 130 and on the entire area of one of the surfaces of the pitch portion 110 facing to the second member 200, as best shown in FIG. 1. The metal film 111 formed on the one surface of the pitch portion 110 serves as the antenna conductor of the plate antenna. A vacuum deposition, plating or coating technique may be used to form these metal films.

A signal from the transmitter/reciver unit is fed through the coaxial cable 220 to the micro strip line 210, which is in turn fed through the feeder pin 130 to the metal film 111 (antenna conductor). A signal from the antenna conductor 111 is fed through the feeder pin 130 to the micro strip line 210, which is in turn fed through the coaxial cable 220 to the transmitter/receiver unit.

In general, when an alternating current J flows through a conductor, an electromagnetic effect (skin effect) occurs to provide a greater current density at the surface of the conductor than in the center thereof. A sufficient high frequencies, the current is confined to the surface of the conductor. If the metal films have a thickness t greater than the thickness of the conductor surface to which the current is confined, the plate antenna have the same electrical performance as conventional plate antennas employing thick metal plates. The thickness t of the metal films may be determined from the following equations:

$$Jt = Jo \cdot e^{-t/\delta} \quad (1)$$

$$t = \sqrt{\rho/\pi \cdot f \cdot \mu} \ (m) \quad (2)$$

where Jo is the current density [A/m$^2$] at the surface of the conductor, Jt is the current density [A/m$^2$] at a point spaced a distance t away from the surface of the conductor. $\delta$ is the skin depth [m], $\rho$ is the specifric resistance [$\Omega$·m] of the metal films, f is the frequency [Hz] of the signal to or from the antenna conductor, $\mu$ is the permeability [H/m] of the metal films, and e is natural logarithm.

Equation (1) is solved for the distance t to obtain $$t = -\delta \cdot ln\ (Jt/Jo) \quad (3)$$

Thus, the distance t at which the current density Jt is one hundredth of the current density Jo is obtained as:

$$t > -\delta \cdot \ln\ (1/100) \quad (4)$$

Assuming now that the metal films are copper films, the specific resistance of the metal film is obtained as $\rho = (1/5.8) \times 10^{-7}$. To use the plate antenna with a land mobile radiotelephone employing a frequency of 900 [MHz], the thickness t of the metal film may be set at a value greater than 10.2 um, as can be seen from Equations (2) and (4).

Figure 4:
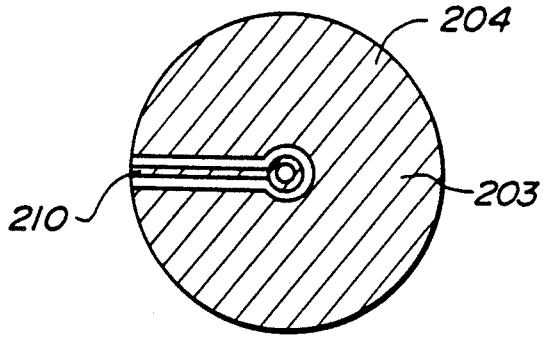
FIG. 4 is a plan view showing a modified form of the second member.

FIG. 4 shows a modified form of the second memebr 200. In this modification, the micro strip line 210 is formed on the one surface of the second member 200 facing to the patch portion of the first member 100. The metal film is formed on the entire area of the one surface of the second member 200 except for an insulation area surrounding the micro strip line 210 to provide an insulation for the micro strip line 210 from the metal film 203.

Figure 5:
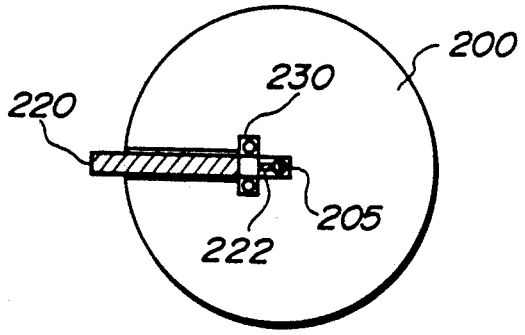
FIG. 5 is a bottom view showing another modified form of the second member.

FIG. 5 shows another modified form of the second member 200. In this modification, the center threads 222 of the coaxial cable 220 is fixed to the feeder pin 130 by a screw 205 with the micro strip line being removed. It is to be noted, of course, that the center threads 222 may be soldered to the feeder pin 130.

Figure 6A:
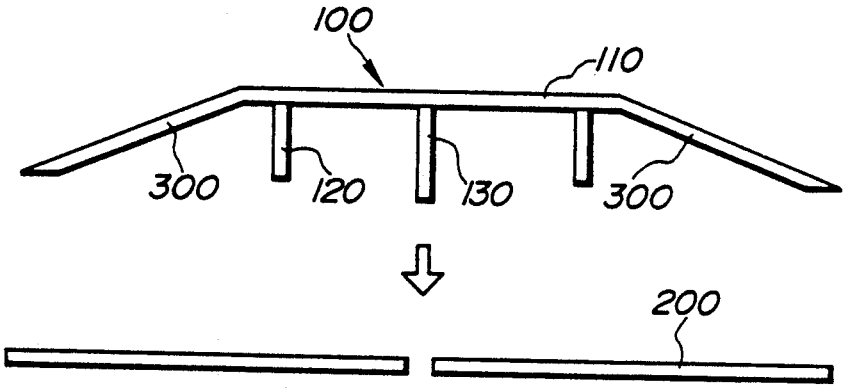
FIG. 6A is an exploded side view showing a second embodiment of the plane antenna of the invention.
Figure 6B:
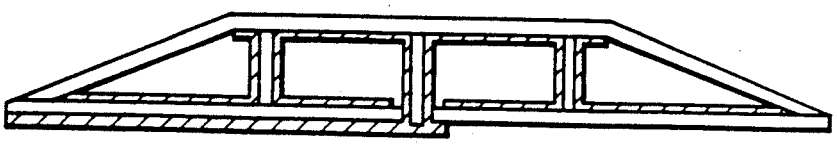
FIG. 6B is a sectional view of the plane antenna of FIG. 6A.

Referring to FIGS. 6A and 6B, there is illustrated a second embodiment of the plate antenna of the invention. In this embodiment, the first member 100 has an inclined annular flange 300 diverging from the pitch portion 110. The inclined annular flange 300 has a circular free end for engagement with the second member 200, as best shown in FIG. 6B. The annular flange 300 defines a closed space between the first and second members 100 and 200 to provide a protection case for the plate antenna. This structure is effective to keep the plane antenna free from dusts and increase the strength of the plate antenna. The annular flange 300 is molded integrally with the rest of the first member by an injection molding technique.

Figure 7A:
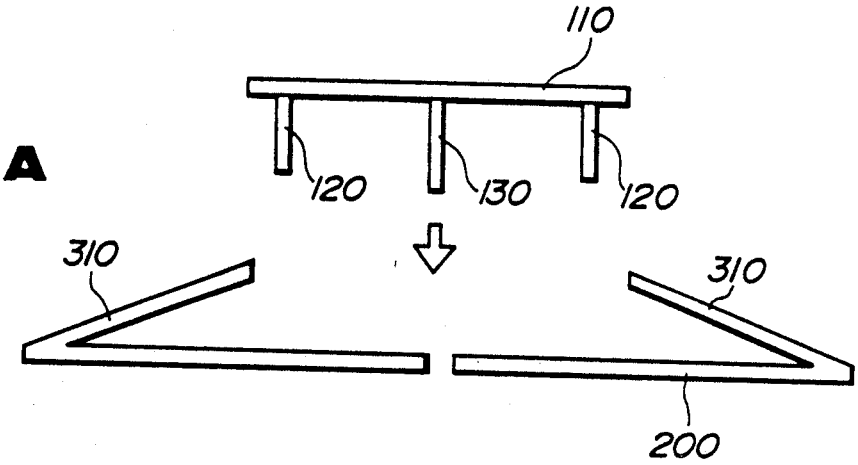
FIG. 7A is an exploded side view showing a modification of the second embodiment.
Figure 7B:
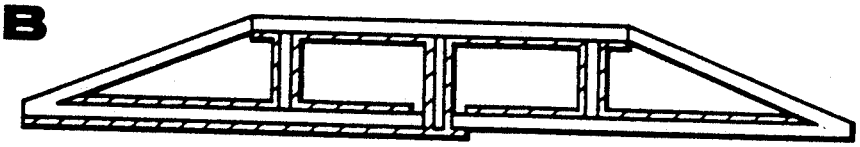
FIG. 7B is a sectional view showing the modification of the second embodiment.

FIGS. 7A and 7B show a modified form of the second embodiment. In this modification, the second member 200 has an inclined annular flange 310 converging from the second member 200. The annular flange 310 defines a closed space between the first and second members 100 and 200 to provide a protection case for the plane antenna. The inclined annular flange 310 has a circular free end for engagement with the patch portion 110 of the first member 100, as best shown in FIG. 7B. The inclined annular flange 310 is molded integrally with the rest of the second member 200 by an injection molding technique.

Figure 8A:
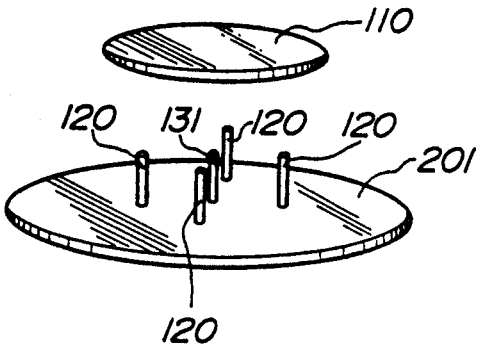
FIG. 8A is an exploded perspective view showing a third embodiment of the plane antenna of the invention.
Figure 8B:
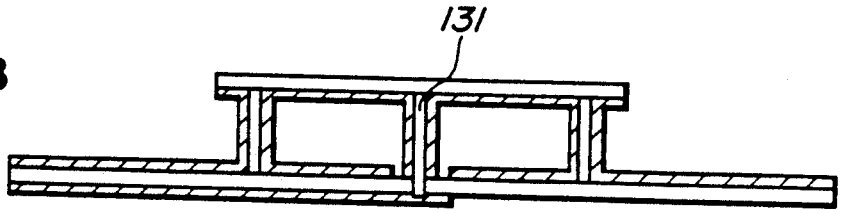
FIG. 8B is a sectional view of the plane antenna of FIG. 8A.

Referring to FIGS. 8A and 8B, there is shown a third embodiment of the plate antenna of the invention. In this embodiment, the first member 100 is a disc-shaped patch 110, whereas the second member 200 has a disc-shaped portion 201 and pins projecting from the disc-shaped portion 201. The pins include a plurality of (in the illustrated case four) short pins 120 spaced circumferentially of the disc-shaped portion 201 and a feeder pin 131 arranged at the center of the disc-shaped portion 201. The second member 200 is produced separately from the first member 100 by an injection molding technique. In this embodiment, the feeder pin 131 is a metal pin provided through an insert molding technique to provide an electric connection to the micro strip line formed in the other surface of the disc-shaped portion of the second member 200. It is to be noted that the feeder pin 131 may be molded integrally with the rest of the second member 200 by an injection molding technique when the micro strip line is formed on the one surface of the disc-shaped portion of the second member 200 as described in connection with FIG. 4. In addition, an inclined annular flange may be provided as described in connection with the second embodiment of invention.

Figure 9A:
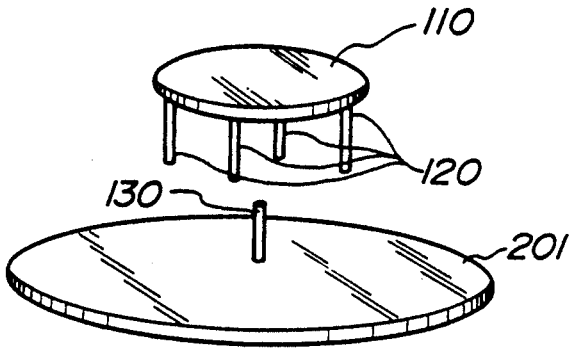
FIGS. 9A to 9C are exploded perspective views showing modifications of the third embodiment.
Figure 9B:
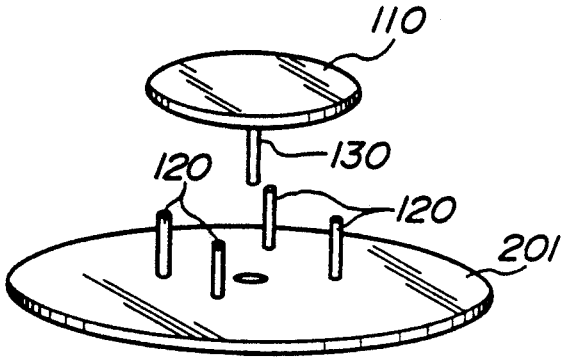
Figure 9C:
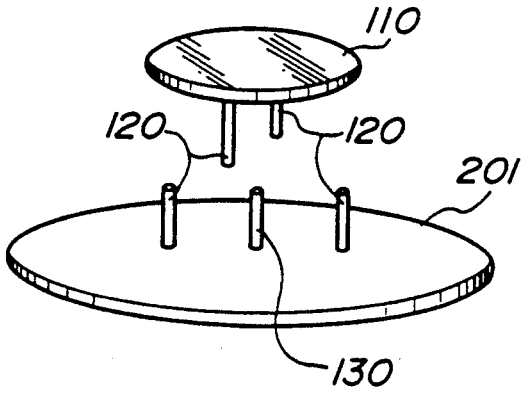

FIGS. 9A to 9C shows several modifications of the invention where at least one of the pins is molded integrally with the first member 100 and the other pins are molded integrally with the second member 200.

In all of the embodiments of the invention, the feeder pin may be a metal pin to increase the strength of the plane antenna. Although the second member 200 has been described as including a disc-shaped earth plate, it is to be noted, of course, that the shape of the earth plate is not limited in any way to the illustrated one.

What is claimed is:

1. A plane antenna comprising:

a first plate made of a synthetic resin, the first plate having a first metal film formed thereon;

a second plate made of a synthetic resin, the second plate having a second metal film formed thereon; and a plurality of pins extending between the first and second plates for maintaining the first and second plates in spaced-parallel relation to each other with the first and second films facing to each other, the pins including at least one first pin for providing an electric connection between the first and second metal films and a second pin insulated from the second metal film for providing an electric connection of the first metal film to a lead wire;

the first and second metal films having a spacific resistance $\rho$ [$\Omega$·m] and a permeability $\mu$ [H/m], the first and second metal films having a thickness greater than a value t [m] calculated from an equation as follows:

$$t = \sqrt{\rho/\pi \cdot f \cdot \mu}$$

where f is a signal frequency (Hz) for which the plane antenna is used.

2. The plane antenna as claimed in claim 1, wherein the first pin includes a pin molded integrally with one of the first and second plates, and a metal film formed therearound.

3. The plane antenna as claimed in claim 2, wherein the second pin includes a pin molded integrally with one of the first and second plates, and a metal film formed therearound.

4. The plane antenna as claimed in claim 1, wherein the second pin includes a pin molded integrally with one of the first and second plates, and a metal film formed therearound.

5. The plane antenna as claimed in claim 1, further including an annular frange for defining a closed space between the first and second plates.

6. The plane antenna as claimed in claim 5, wherein the annular flange is molded integrally with one of the first and second plates through an injection molding.

* * * * *